US005845793A

United States Patent [19]

Pan

[11] Patent Number: 5,845,793

[45] Date of Patent: Dec. 8, 1998

[54] MULTI-FUNCTIONAL DISPLAY RACK

[75] Inventor: Pang-Hui Pan, Chanchua Hsien, Taiwan

[73] Assignee: Main Good Furniture Co., Ltd., Lukang Chen Changhua Hsien, Taiwan

[21] Appl. No.: 752,522

[22] Filed: Nov. 20, 1996

[51] Int. Cl.[6] ..... A47F 5/14; A47B 3/00

[52] U.S. Cl. ..... 211/181.1; 211/149; 108/163; 108/134

[58] Field of Search ..... 211/181.1, 104, 211/106, 90.01, 90.03, 195, 149; 108/29, 115, 134, 163, 181; 312/5, 6

[56] References Cited

U.S. PATENT DOCUMENTS

| | | | |
|---|---|---|---|
| 3,085,694 | 4/1963 | Jones | 211/181.1 X |
| 3,908,562 | 9/1975 | Wittschen | 108/163 X |
| 4,313,544 | 2/1982 | Ashton | 108/163 X |
| 4,726,602 | 2/1988 | Sanders et al. | 211/181.1 X |
| 5,167,331 | 12/1992 | Luukkonen | 211/181.1 X |
| 5,592,887 | 1/1997 | Teng | 108/163 X |

*Primary Examiner*—Peter M. Cuomo
*Assistant Examiner*—James O. Hansen
*Attorney, Agent, or Firm*—Bacon & Thomas

[57] ABSTRACT

A multi-functional display rack including a base structure in combination with movable side walls provided with fan-shaped side racks is disclosed. The base structure fabricated by a rear wall and two lateral side walls and equipped with a table face, an upper layer, and a lower layer is mainly retained by two metallic rectangular posts, each having two pivoting plates disposed at both upper and lower outer side thereof. The movable side wall fabricated mainly by a pivoting post and a supporting leg is provided with three transverse beams, each having two annular tubes pivotally joined to one side of the fan-shaped side racks. The pivoting post thereof can be joined to the pivoting plates thereof via screws so as to engaged the movable side wall with the rear wall of the base structure. And one other side of the fan-shaped side racks can be attached to the arhced supporting plates disposed at the outer side of the table face, the upper layer, and the lower layer of the base structure respectively so as to display the fan-shaped side racks for use. In addition, the movable side wall and the fan-shaped side racks can be adjustably folded up and stored against the base structure when not in use to achieve the most efficient use of space.

1 Claim, 4 Drawing Sheets

MULTI-FUNCTIONAL DISPLAY RACK

BACKGROUND OF THE INVENTION

The present invention relates to a multi-functional display rack, comprising a base structure and movable side walls, each fabricated by a pivoting post, a supporting leg, and fan-shaped side racks. The base structure is mainly sustained by two metallic rectangular posts, each having two pivoting plates at one outer side to engage with the pivoting post of the movable side wall. The fan-shaped side racks, each pivotally joined at one side to a transverse beam of the movable side wall are capable of attaching at one other side to arched supporting plates disposed at the outer side of a table face, an upper layer, and a lower layer of the base structure respectively so as to display the fan-shaped side racks for use. In addition, the movable side wall and the fan-shaped side racks can be flexibly adjusted and folded up against the base structure in accordance with different requirements.

Please refer to FIG. 1. A conventional display rack is mainly retained by two metallic rectangular posts 10. A rear wall 11 having an arch at the top is fabricated by many metallic rods disposed therebetween the two metallic rectangular posts 10. Besides, several metallic rods are disposed extending forwardly from one side of each metallic rectangular posts 10 to fabricate two lateral side walls 12, each defining a descending slope at the top. A table face 13 provided with a drawer 14 therebeneath is disposed at a proper height within the space enclosed by the rear wall 11 and the two lateral side walls 12. An upper layer 15 fabricated by transverse metallic rods with a shallow surface is disposed above the table face 13. And a lower layer 16 fabricated by transverse metallic rods with a deep surface is disposed under the table face 13.

Accordingly, a conventional display rack as shown in FIG. 1 is inflexibly constituted by three layers—an upper layer, a table face, and a lower layer—for exhibition of articles. However, it is structurally dull and functionally limited. The conventional display rack cannot be flexibly adjusted according to different requirements to achieve the most efficient use of space.

SUMMARY OF THE PRESENT INVENTION

It is therfore the primary object of the present invention to provide a multi-functional display rack wherein movable side walls provided with flexible fan-shaped side racks are adjustably attached to the base structure of a conventional display rack at both lateral sides so as to efficiently enlarge the exhibiting space of the rack as well as to flexibly vary the layout of the display rack as one likes.

It is a further object of the present invention to provide a multi-functional display rack wherein the movable side walls and the fan-shaped side racks attached to the base structure thereof can be flexibly folded up and store against both lateral sides of the base structure for easy carrying or to save the space of occupation.

DETAILED DESCRIPTION OF THE PREFERRED EMBODIMENT

Figure 1:
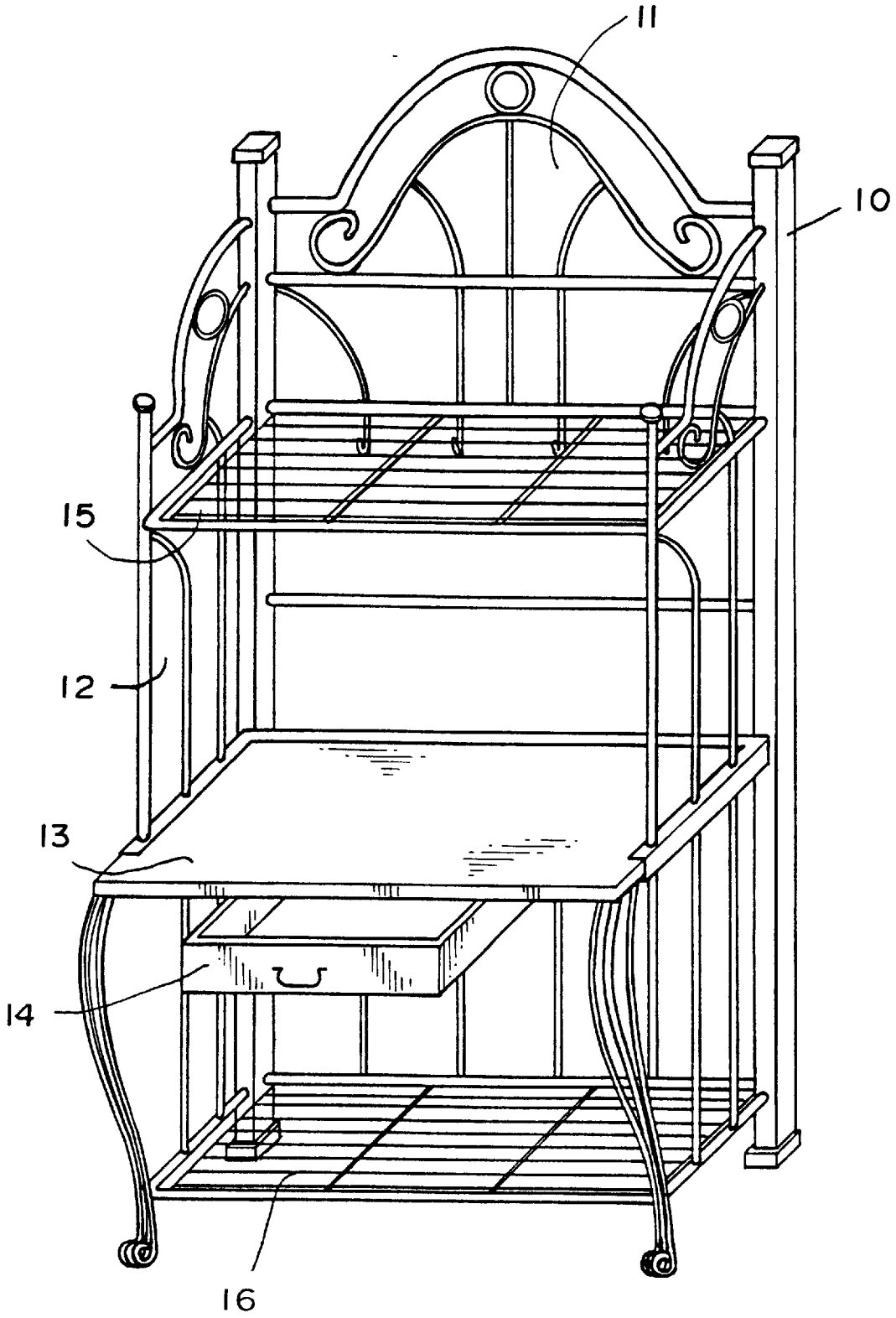
FIG. 1 PRIOR ART
FIG. 1 is a perspective view of a conventional display rack.
Figure 2:
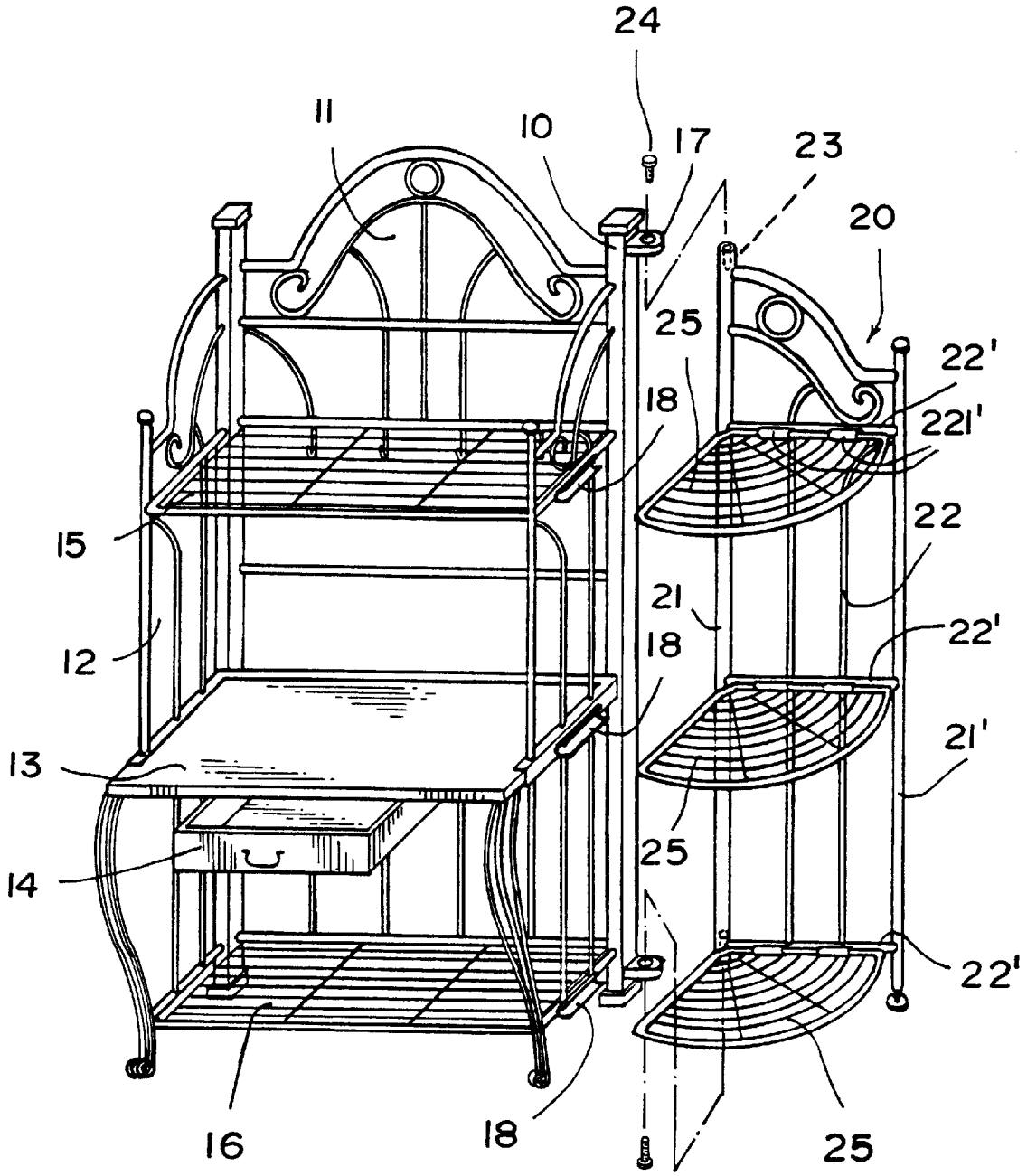
FIG. 2 is a perspective exploded view of the present invention.

Please refer to FIG. 2. The present invention relates to a multi-functional display rack, comprising a base structure having two metallic rectangular posts 10 disposed at both rear corners as supporting legs. A rear wall 11 forming an arch at the top is fabricated by a number of metallic rods disposed therebetween the two metallic rectangular posts 10. And two lateral side walls 12, each defining a descending slope at the top, are fabricated by a number of metallic rods extending forwardly at one side of each metallic rectangular post 10. A table face 13 provided with a drawer 14 therebeneath is located at a proper height within the space enclosed by the rear wall 11 and the two lateral side walls 12 thereof. An upper layer 15 fabricated by transverse metallic rods with a shallow surface is disposed above the table face 13 and a lower layer 16 fabricated also by transverse metallic rods with a deeper surface is disposed under the table face 13.

By means of the base structure above, two pivoting plates 17 having through holes thereon are disposed at both upper and lower outer sides of each metallic rectangular post 10 respectively. And both outer sides of the table face 13, the upper layer 15 and the lower layer 16 are welded with an arched supporting plate 18 respectively. A movable wall 20 fabricated by a pivoting post 21 and a supporting leg 21' with several metallic rods welded therebetween is capable of foldably engaged with the lateral side walls 12 of the base structure via the pivoting post 21. The length of the pivoting post 21 is shorter than the distance between the two pivoting plates 17 which, leaving a gap therebetween, enables a plastic fixing block 23 to be inserted into both ends of the pivoting post 21 respectively.

Figure 4B:
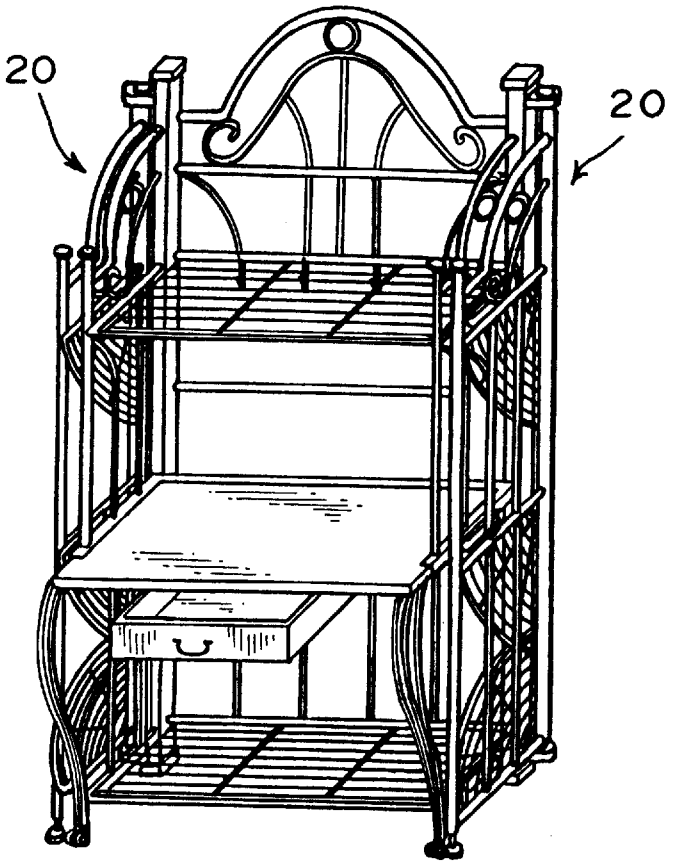
FIG. 4B is a diagram showing both movable side walls and fan-shaped racks of the present invention fully folded up against the base structure.
Figure 4A:
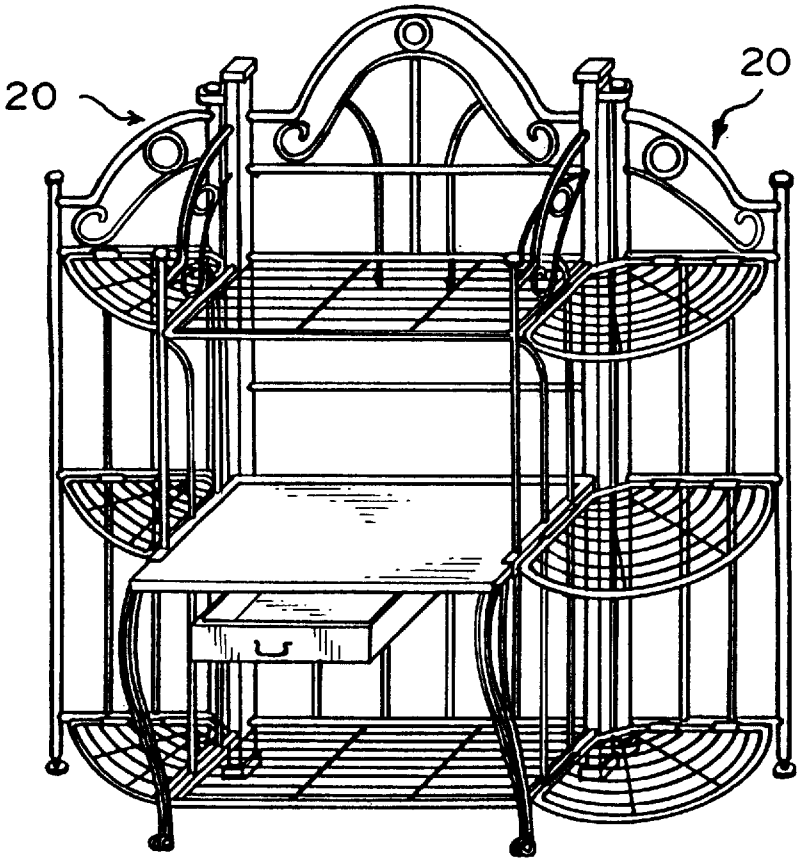
FIG. 4A is a diagram showing the present invention fully displayed.

The pivoting post 21 of the movable wall 20 can be located between the two pivoting plates 17 disposed at both upper and lower outer side of the metallic rectangular post 10. Both ends of the pivoting post 21 are then matched and locked to the pivoting plates 17 by screws 24 passing through the through holes of the pivoting plates 17 and the plastic fixing blocks 23 inserted at both ends of the pivoting post 21, so as to engage the movable wall 20 with the metallic rectangular post 10 of the base structure. Three transverse beams 22', each provided with two annular tubes 221' by welding, are disposed at the movable wall 20 at a height corresponding respectively to that of the table face 13, the upper layer 15, and the lower layer 16 of the base structure. Both annular tubes 221' of each transverse beam 22' are previously and pivotally jointed to one side of a fan-shaped side rack 25. One other side of the fan-shaped side rack 25 is adapted to match the arched supporting plate 18 welded at the outer side of the table face 13, the upper layer 15, and the lower layer 16 respectively. The movable wall 20 must be slightly lifted upwardly to juxtapose the pivoting post 21 in alignment with the rear wall 11 of the base structure while the fan-shaped side racks 25 are attached at one other side to the arched supporting plates 18 of the table face 13, the upper layer 15, and the lower layer 16 respectively. Finally, the movable side wall 20 and the attached fan-shaped side racks 18 are retained stably on ground by the supporting leg 21' disposed at one side of the movable side wall 20 to manifest an unfolded display shelf as shown in FIG. 4*a*.

Figure 3:
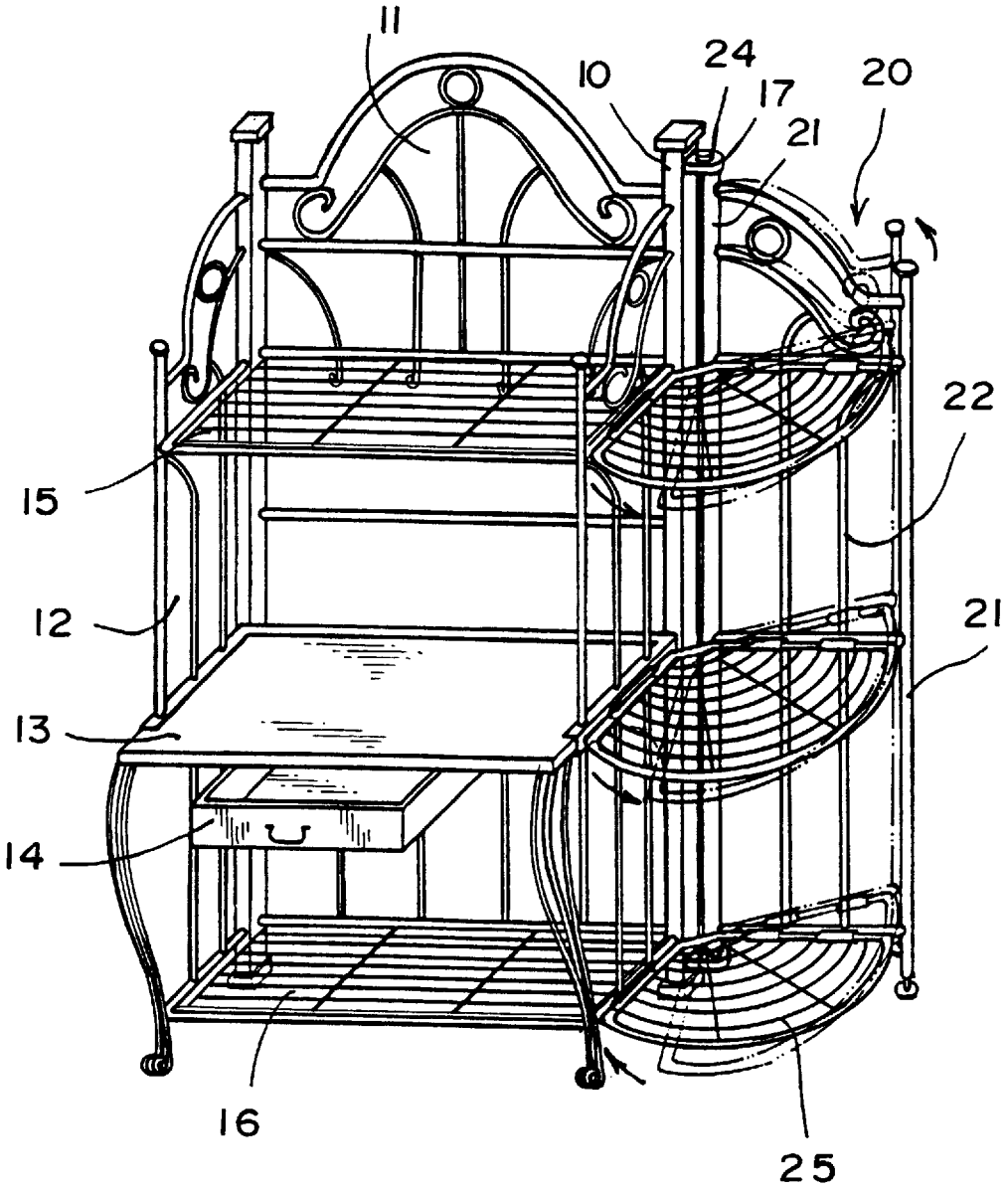
FIG. 3 is an operational diagram showing the movable side wall and the fan-shaped racks of the present invention being folded up against the base structure.

Please refer to FIG. 3. The fan-shaped side racks 18 disposed at both lateral sides of the base structure can be folded up if not in use. The movable side wall 20 is slightly lifted upwardly, detaching the supporting leg 21' from the ground and then swinging slightly backwards. The fan-shaped side racks 25 attached to the arched supporting plates 18 of the table face 13, the upper layer 15, and the lower layer 16 will come off from said arched supporting plates 18 respectively. The first two upper fan-shaped side racks 25 are then swung downwards while the third lowerest fan-shaped side rack 25 turned upwards so as to collect said racks 25 against the movable side wall 20. Finally, the movable side wall 20 retained at one side by the supporting leg 21' is aligned against the lateral side of the base structure to display a folded-up structure of the display rack as shown in FIG. 4*b*.

By the above arrangement, the movable side wall 20 can be flexibly adjusted in accordance with different occassions to achieve the most sufficient use of space—either fully displayed at both lateral sides of the base structure, partially unfolded at only one lateral side of the base structure, or simply folded up against both lateral sides of the base structure.

What is claimed is:

1. A multi-functional display rack, comprising a base structure in combination with movable side walls provided with three fan-shaped side racks; wherein the base structure is mainly retained by two metallic rectangular posts having a rear wall fabricated by metallic rods disposed therebetween and two lateral side walls extending forwardly from one side of the metallic rectangular posts; a table face having a drawer disposed therebeneath is disposed within a space enclosed by said rear wall and lateral side walls, an upper layer is disposed above said table face, and a lower layer disposed under said table face; wherein, two pivoting plates, each having a through hole thereon, are disposed at both an upper and a lower outer side of each of the metallic rectangular posts, while an arched supporting plate is welded at both outer sides of the table face, the upper layer, and the lower layer respectively;

the movable side wall, fabricated mainly by a pivoting post and a supporting leg with several metallic rods welded therebetween, is provided with three transverse beams disposed at a height corresponding respectively to that of the table face, the upper layer, and the lower layer; and each transverse beam is weldedly joined with two annular tubes;

the fan-shaped side racks, each pivotally joined at one side to the annular tubes of said transverse beams of the movable wall, are adapted to match at one other side the arched supporting plates of the table face, the upper layer, and the lower layer thereof;

whereby; the movable side wall can be adjustably engaged with the metallic rectangular post, said pivoting post whose length is shorter than the distance between the two pivoting plates and whose ends are inserted with plastic fixing blocks, being located between said pivoting plates and locked thereon via screws passing through the through holes of said pivoting plates and the plastic fixing blocks of said pivoting post; while the fan-shaped side racks joined at one end to the transverse beams of the movable side wall are attached at one other side to the arched supporting plates of the table face, the upper layer, and the lower layer of the base structure respectively so as to display the same for use; finally the movable side wall and the fan-shaped side racks are retained stably on ground by the supporting leg disposed at one side of the movable side wall; in addition, the movable side wall and the fan-shaped side racks can be foled up against the base structure when not in use; the movable side wall being lifted slightly upwardly to detach said supporting leg from the ground and the fan-shaped side racks from said arched supporting plates respectively; the first two fan-shaped side racks then swung downwardly while the third rack is turned upwardly so as to collect said racks against the movable side wall; the movable side wall finally closed against the lateral side of the base structure to fold up and store the movable side wall against the base structure.

* * * * *